US008282310B2

(12) United States Patent
White

(10) Patent No.: US 8,282,310 B2
(45) Date of Patent: Oct. 9, 2012

(54) PAVER INSTALLATION SYSTEM

(76) Inventor: Charles R. White, Worton, MD (US)

( * ) Notice: Subject to any disclaimer, the term of this patent is extended or adjusted under 35 U.S.C. 154(b) by 162 days.

(21) Appl. No.: 12/944,385

(22) Filed: Nov. 11, 2010

(65) Prior Publication Data

US 2012/0121328 A1 May 17, 2012

(51) Int. Cl.
*E01C 13/02* (2006.01)

(52) U.S. Cl. ..... 404/18; 404/27; 404/28; 404/29

(58) Field of Classification Search ..... 404/18, 404/27, 28, 29, 31, 34, 35, 36, 43
See application file for complete search history.

(56) References Cited

U.S. PATENT DOCUMENTS

| | | | | |
|---|---|---|---|---|
| 450,286 | A * | 4/1891 | Enricht | 404/18 |
| 4,621,942 | A | 11/1986 | Hill | |
| 5,238,721 | A * | 8/1993 | Nakazawa | 428/44 |
| 5,250,340 | A | 10/1993 | Bohnhoff | |
| 5,323,575 | A * | 6/1994 | Yeh | 52/177 |
| D442,704 | S | 5/2001 | Lee | |
| 6,694,691 | B2 * | 2/2004 | Ku | 52/403.1 |
| 6,718,714 | B1 * | 4/2004 | Montgomery, Sr. | 52/392 |
| 6,817,806 | B1 * | 11/2004 | Arellanes | 405/114 |
| 6,851,236 | B1 * | 2/2005 | Harvey | 52/403.1 |
| 7,344,334 | B2 * | 3/2008 | Thorkelson | 404/29 |
| 7,544,010 | B2 * | 6/2009 | Restrepo et al. | 404/21 |
| 7,591,611 | B2 * | 9/2009 | Arellanes et al. | 405/114 |
| 2007/0274776 | A1 | 11/2007 | Urriola | |
| 2008/0163566 | A1 | 7/2008 | Bella | |
| 2009/0038238 | A1 | 2/2009 | Kurtz et al. | |
| 2009/0232597 | A1 | 9/2009 | Zwier et al. | |
| 2009/0242731 | A1 | 10/2009 | Dinkins | |
| 2009/0274514 | A1 | 11/2009 | Scheiwiller | |

* cited by examiner

*Primary Examiner* — Gary S Hartmann
(74) *Attorney, Agent, or Firm* — Richard C. Litman

(57) ABSTRACT

The paver installation system includes a grid having a plurality of mounting holes for selective installation of spacers, a flexible edging and a screed guide rail. The screed guide rail may be selectively installed on the grid via mounting pegs mounted in select mounting holes for screeding an intermediate layer of aggregate material between the grid and the pavers to be laid thereon. The flexible edging is attached to the grid in order to set the edges of the pavement to be laid, and the flexibility thereof easily accommodates curved edges by bending to conform to the curves. The spacers are laid onto user selected mounting holes in the grid in order to serve as guides for laying pavers in a desired pavement pattern and to maintain spacing between adjacent pavers.

20 Claims, 7 Drawing Sheets

PAVER INSTALLATION SYSTEM

BACKGROUND OF THE INVENTION

1. Field of the Invention

The present invention relates to landscaping devices and methods, and more specifically to a paver installation system for easy and accurate installation of paved surfaces in a variety of patterns.

2. Description of the Related Art

Paved surfaces are seen everywhere, whether they be on grass, gravel, soil or hardtop. These surfaces usually include bricks of various materials, cobblestones, concrete slabs in various forms and specialty products made from exotic materials. Moreover, the paved surfaces are arranged in recognizable patterns and/or follow a defined path. In all respects, these provide the individual and general public with an aesthetically appealing and functional surface where the populace may walk, ride or drive in relative comfort.

While the end product or pavement may be functional and appealing, the process of installing pavers (as used herein, the term "paver" refers to elements used to make the surface, e.g. bricks, cobblestones, gravel, etc.) is a time-consuming and inefficient task. For example, a typical paver installation requires excavation to a desired depth, removal of the excavated material, hauling and placement of aggregate material, compaction of the aggregate, and screeding to level the aggregate. A round bar or pipe is usually used as the edge to screed over. Unfortunately, when the pipe is removed, the pipe leaves a depression in the screed layer that requires filling in.

Another example is the inefficient process for laying the pavers. After the base ground layer has been prepared with an aggregate layer, the paver is laid atop the aggregate in a desired pattern, e.g., herringbone, basket weave, etc. In most instances, the pattern is usually constructed without physical guides, i.e., there is no template or guide to follow except for the skill and eye of the installer. This process takes longer to produce the desired patterned pavement. One solution to the above involves a mat having integral raised guide rails thereon. An installer must use proprietary pavers or bricks with matching grooves to lay down a set pattern. While this solution substantially reduces the time required to lay down a pattern, the user or installer is limited in pattern choice, as well as in the specific paver material.

A further example involves the finished paved surface. Paver installations often have individual or multiple pavers settling because of failure of the base material. This results in uneven and unsightly paved surfaces that can be potentially dangerous to the unwary. In these situations, the pavers must be removed, the base material leveled and the pavers reinstalled, which is duplicative and an inefficient use of time and work.

Besides the above, some areas require paved surfaces to be able to disperse water back to the ground. This is a concern because the drainage systems in some areas are overstressed, especially in rainy weather, which can lead to flooding of community drainage and sewage systems. Many pavements exist that do not have such a standing water dispersion system in place, and over time, this can lead to environmental concerns. In light of the above, it would be a benefit in the landscaping art to provide a paving system for easy and efficient installation of pavers with environmentally friendly features.

Thus, a paver installation system solving the aforementioned problems is desired.

SUMMARY OF THE INVENTION

The paver installation system includes a grid having a plurality of mounting holes for selective installation of spacers, a flexible edging and a screed guide rail. The screed guide rail may be selectively installed on the grid via mounting pegs mounted in select mounting holes for screeding an intermediate layer of aggregate material between the grid and the pavers to be laid thereon. The flexible edging is attached to the grid in order to set the edges of the pavement to be laid, and the flexibility thereof easily accommodates curved edges by bending to conform to the curves. The spacers are laid onto user selected mounting holes in the grid in order to serve as guides for laying pavers in a desired pavement pattern and to maintain spacing between adjacent pavers.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
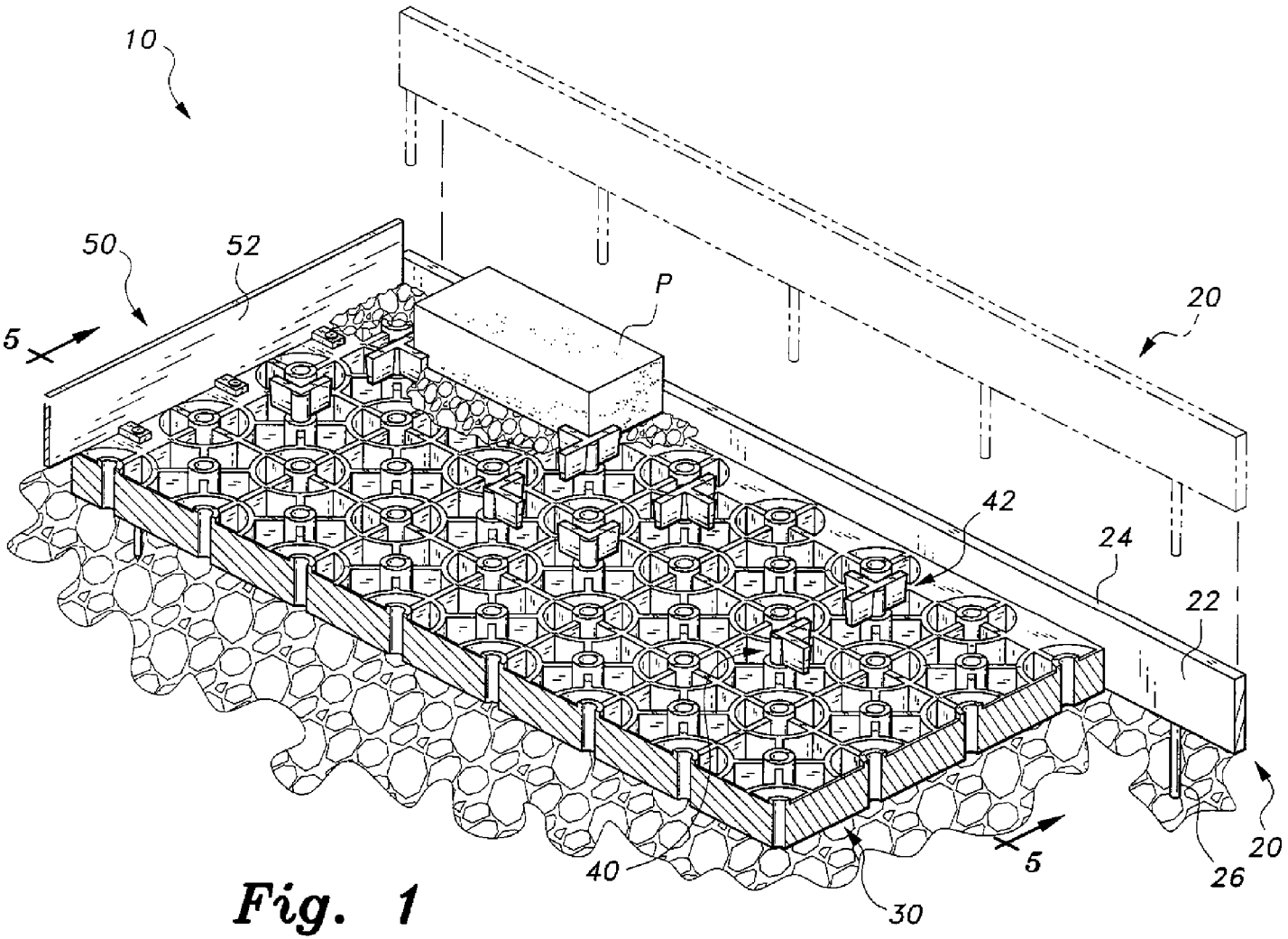
FIG. 1 is an environmental, perspective view of a paver installation system according to the present invention.

The present invention relates to a paver installation system, generally referred to in the drawings by reference number 10, for easy and efficient installation of pavers. As shown in FIG. 1, the paver installation system 10 includes a removable screed guide rail 20, a grid or mat 30, spacers 40, 42, 44, and flexible edging 50.

The screed guide rail 20 may be an elongate rectangular beam or bar 22 with a plurality of mounting bolts or pegs 26 extending down from the bottom. The width or height of the rectangular bar corresponds to the desired thickness of aggregate material, e.g., rock, sand, soil, etc., to be leveled or screed. The top edge serves as the guide edge 24 for screeding, i.e., a bar or similar element is laid on the guide edge 24 and moved along the guide edge 24 to level the aggregate material. The rectangular bar 22 is preferably made from durable plastic or metal that can withstand repeated use. Other similar materials may also be used. The mounting pegs 26 may be fastened, adhered or integrated to the screed guide rail 20.

The grid 30 is preferably traffic-rated to handle repeated foot and/or vehicle traffic. The grid 30 includes internal open spaces that can be filled with stone or a top surface that restricts the stone from filling the internal open spaces. The grid 30 is constructed to provide more open area for water that has passed through the joins between adjacent pavers to trickle down into the soil below. Moreover, the grid 30 stabilizes the base under the pavers to prevent excessive settling or downward movements of individual pavers. In this manner, the combination of water storage in a relatively small area and the stable structure of the grid 30 permits the user to reduce the depth of the base material, resulting in reduction of excavated material and disposal thereof, as well as the amount of aggregate required for the paver installation.

Figure 2:
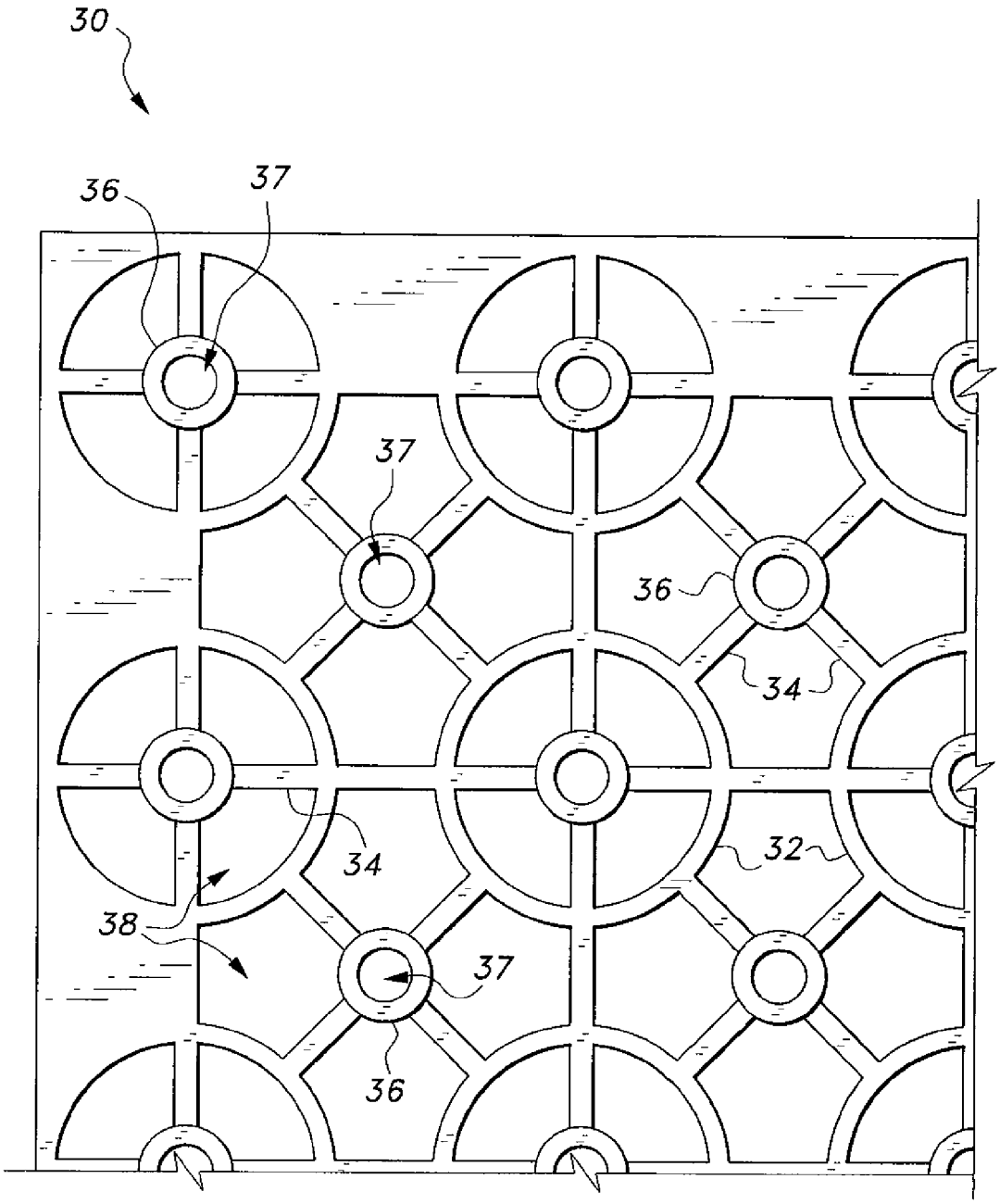
FIG. 2 is a partial top view of a grid for the paver installation system according to the present invention, showing details thereof.

As shown in FIGS. 1 and 2, a stone or intermediate layer is laid on top of the grid or mat 30 for the pavers P to be laid. The grid 30 serves as a buffer between the crushed stone base or foundation on the prepared ground and the pavers P via the intermediate layer. Without such a grid, the chances of uneven and/or eventual settling of the paved surfaces increases over time as foot and tire traffic tamps down the pavers.

The grid 30 may be a square with a pattern forming a honeycomb like structure. This results in a lightweight and durable structure strong enough to handle years of wear. In this embodiment, the pattern on the grid 30 includes a plurality of rows of cylindrical tubes 32 interlaced by a plurality of relatively thin walls 34. Many of the junctures of the thin walls include a mounting post 36 defining a mounting hole 37, the purpose of which will be further explained below. These mounting posts 36 and holes 37 are raised to be about 1/32 in. less than the elevation of the guide edge 24 on the screed rail guide 20. Moreover, the diameter of the holes 37 is smaller than the smallest chipped stone used to layer on top of the grid 30, e.g., less than 1/4 in., which helps to prevent the chipped stone from falling into the mounting hole 37. Alternatively, a thin layer of material that can be easily punctured or removed may cover the mounting hole 37. The space between the walls 34 forms discreet cells, cavities or chambers 38 that can store water and/or be filled with aggregate material, such as crushed stone. In both instances, the stored water will be slowly dispersed back into the ground. One row of mounting holes 37 near one of the edges of the grid 30 or the outer edge of the grid 30 may be used to removably install the screed guide rail 20 via the mounting pegs 26. As an alternative, this row of mounting holes may be configured to be at a lower elevation relative to the rest of the mounting holes 37 as a way of distinguishing the row for use by the screed guide rail 20. Furthermore, the grid 30 may include interlocking features to lock adjacent grids to each other.

Once the grid 30 is laid and covered with a layer of crushed stone, the grid 30 is ready for laying out the pavers P in a desired pattern. To facilitate laying out the pavers P, the paver installation system 10 includes a plurality of spacers 40, 42, 44 in various configurations. The spacers 40, 42, 44 function as guides for evenly spacing the pavers P on the grid 30. Moreover, the spacers 40, 42, 44 may be arranged in any desired pattern on the grid 30 corresponding to the desired pattern of the paved surface, such as herringbone, basket weave, simple offset blocks, etc.

Figure 3:
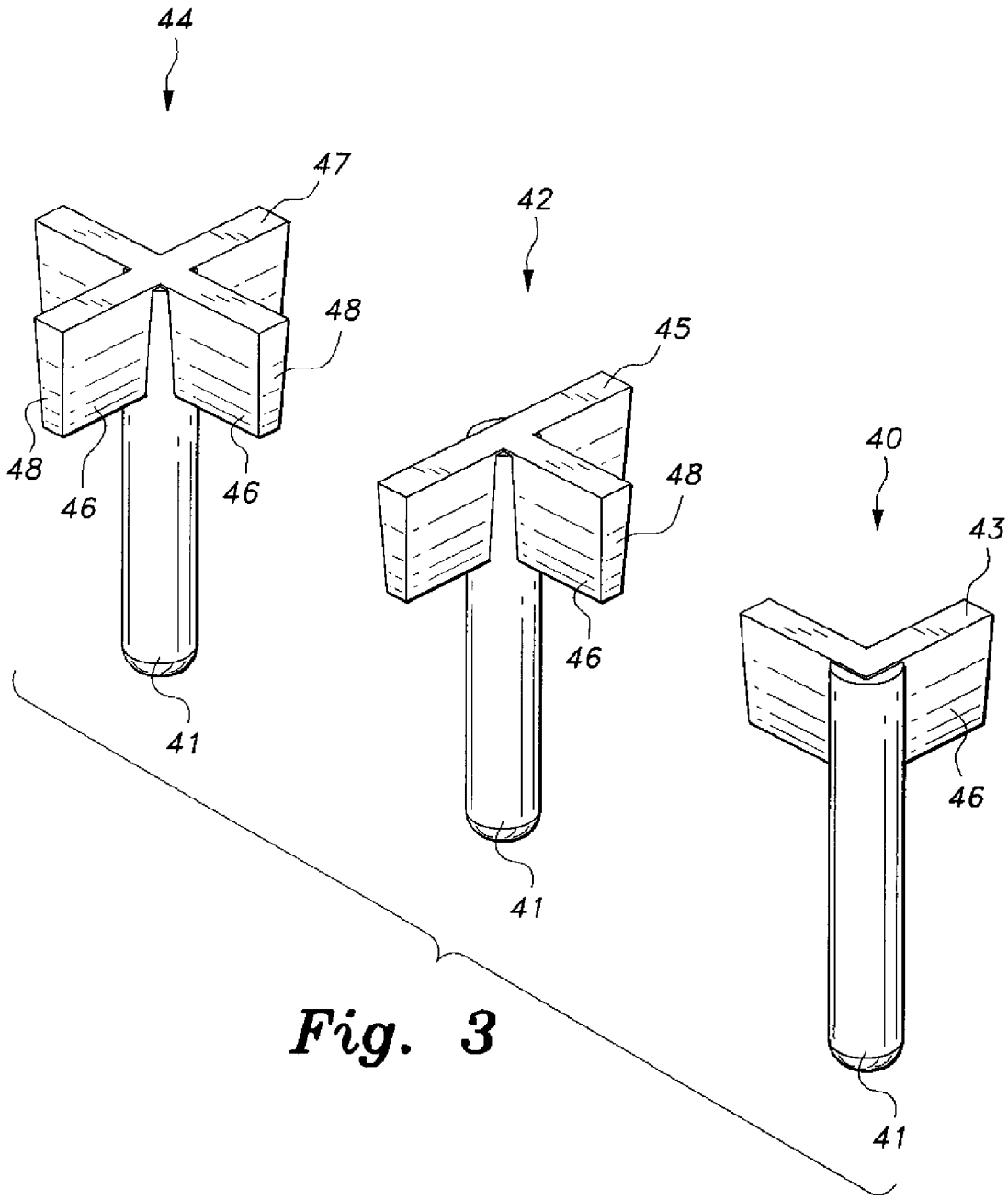
FIG. 3 is a perspective view of an assortment of spacers for the paver installation system according to the present invention.

As shown in FIGS. 1 and 3, each spacer 40, 42, 44 includes a mounting post or peg 41. The mounting peg 41 is used to install the spacers 40, 42, 44 into the mounting holes 37 on the grid 30. Each spacer 40, 42, 44 also includes a respective head configuration corresponding to a particular fin or divider arrangement. For example, the L-spacer 40 includes a head 43 with radiating fins or dividers forming an L-shape when viewed from the top. The T-spacer 42 includes a head 45 with fins or dividers forming a T-shape, and the cruciform spacer 44 includes fins or dividers forming the shape of a cross. Each fin has a wedge shape from top to bottom that is defined by tapering side surfaces 46 and a tapering end surface 48. Once installed, pavers set, and joints filled with aggregate, the wedge-shaped fins help resist upward movement of the pavers due to the aggregate being wedged against the fins. This effectively locks the laid pavers P in place. Moreover, the mounting holes 37 and the spacers 40, 42, 44 may be color-coded for even faster setup and installation.

Figure 4:
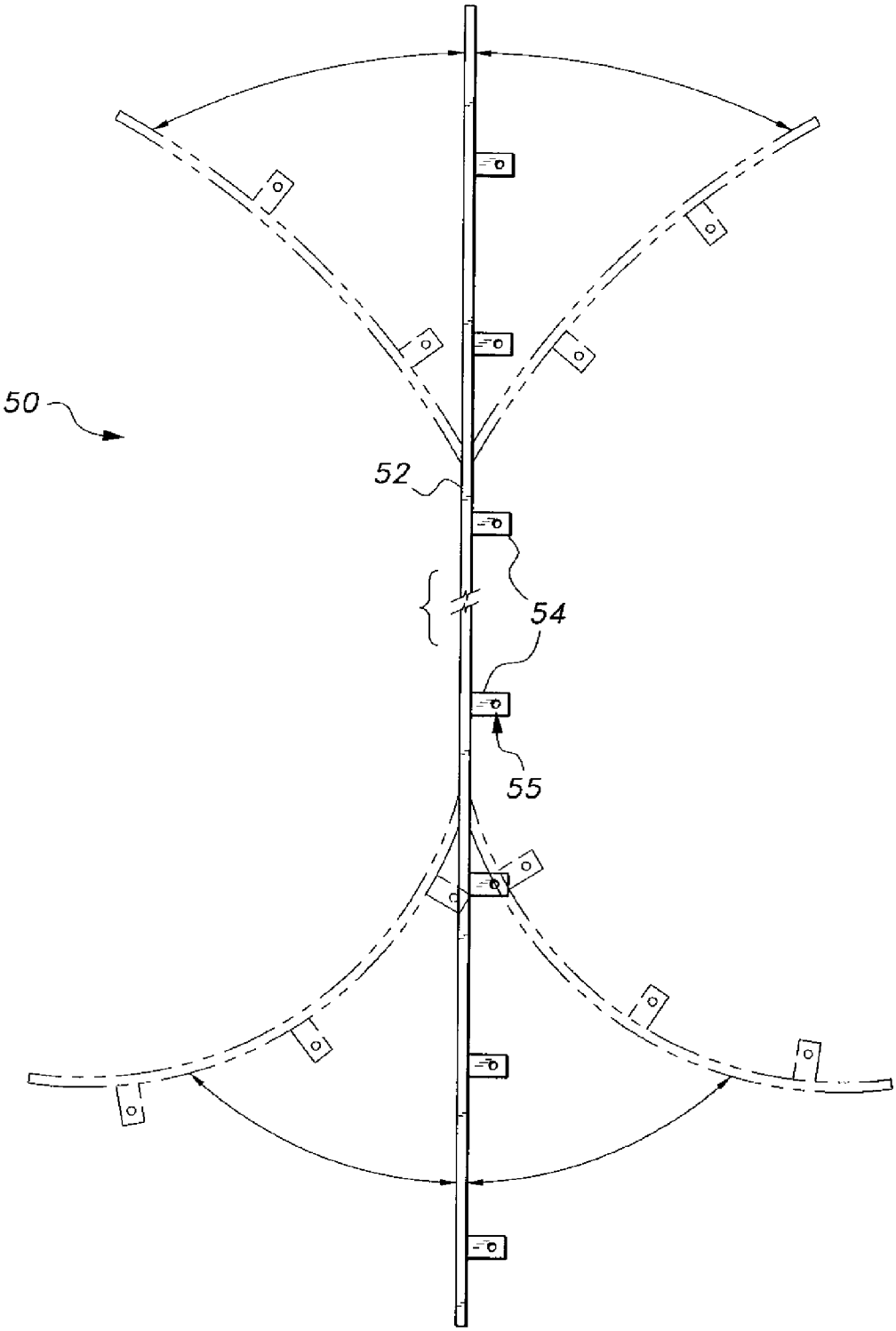
FIG. 4 is a top view of flexible edging for the paver installation system according to the present invention.
Figure 5:
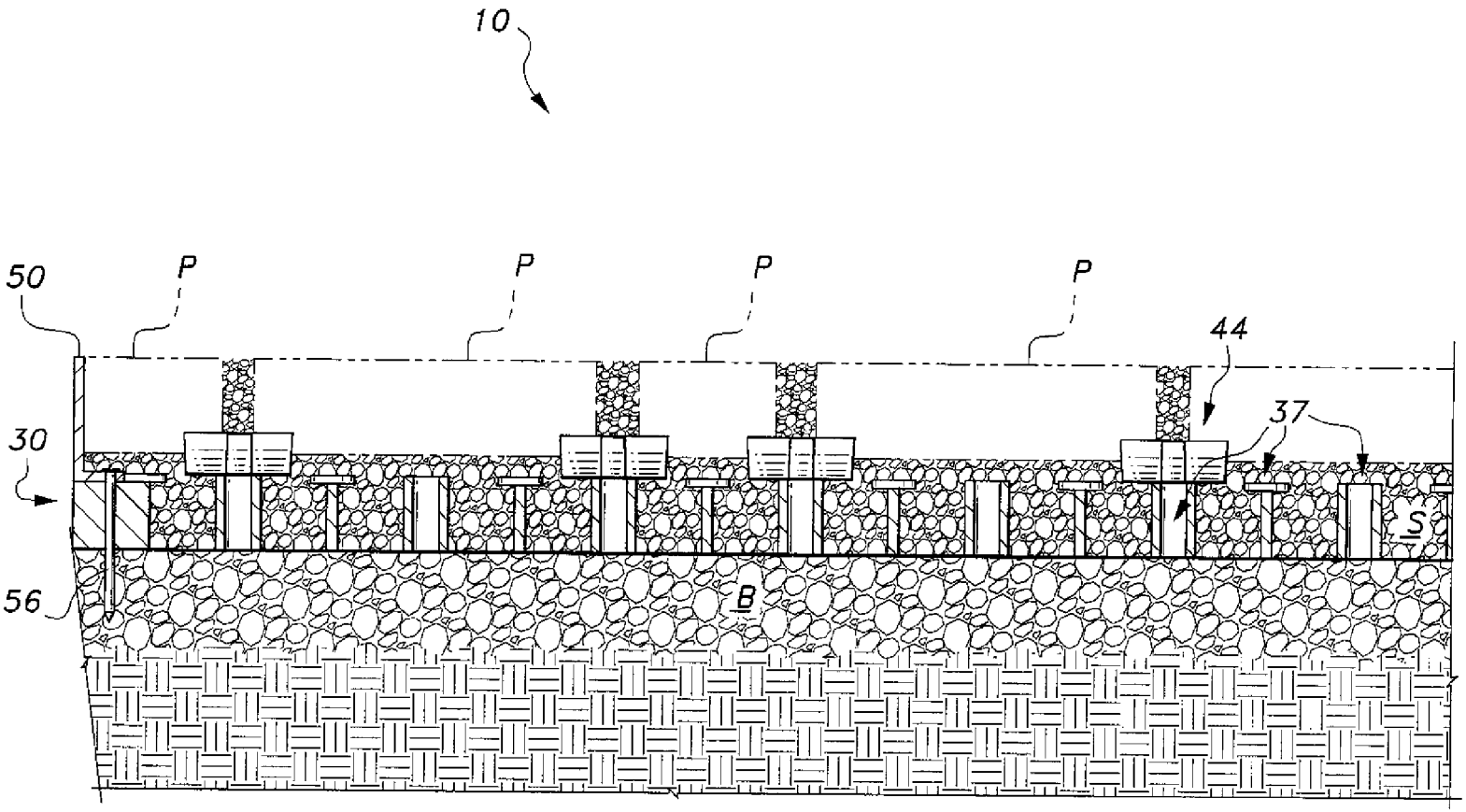
FIG. 5 is a section view taken along lines 5-5 of FIG. 1.

As shown in FIGS. 4 and 5, the paver installation system 10 also includes flexible edging 50 to define the edges of the pavement. The flexible edging 50 may be an elongate, flat strip 52 made from durable and flexible material. A plurality of mounting tabs or flanges 54 extend from the bottom of the flexible edging 50. Each mounting tab 54 includes a mounting hole 55 to secure the edging 50 onto the grid 30 via fasteners 56. The majority of the edging conventionally used for paving usually comprises a stiff beam, which works well for straight edges, but not for curves or rounded edges of a pavement. The flexible edging 50 provided with the system 10 can easily be bent or flexed to match the desired curved contour or radius, and then fixed in position with the fasteners on top of the grid 30. The edging 50 may also be affixed to the ground adjacent the grid 30.

The following describes how to use the paver installation system 10. With reference to FIG. 5, the ground is excavated to a predetermined depth in preparation for paving. A layer of base material B such as crushed stone is laid on the excavated ground. This layer is then compacted and leveled. Once leveled, one or more of the grids 30 is laid in the area to be paved. Since the grids 30 have straight edges, they are easily aligned with each other as well as the spacers to be mounted thereon. The grids 30 may also include interlocking features to mount the grids 30 together. The flexible edging 50 is installed either adjacent to or on the grid 30. For radius or curved edges, the flexible edging 50 is always mounted on the grid 30. The screed guide rail 20 is then installed on the grid 30. An intermediate layer of crushed stone S is laid atop the grid 30, and then screed using the guide edge 24. The size of the crushed stone is larger than the diameter of the mounting holes 37 so that even when covered, the screeding or leveling will reveal the covered holes 37. In addition, the height of the mounting posts 36 is slightly below the elevation of the guide edge 24, i.e., about 1/32 in. lower, to help facilitate uncovering of the mounting holes 37.

The screed guide rail 20 is then removed after screeding. Any loose stones that fall into the cells will be loosely packed so that they will not adversely impact water dispersion. Now the user may install a plurality of spacers 40, 42, 44 in a pattern corresponding to the desired paved pattern. For further assistance, a template may be used to install the spacers 40, 42, 44. Using the pattern laid out by the spacers 40, 42, 44, the user then lays the pavers P in the desired pattern at a faster rate than without the spacers 40, 42, 44, i.e., the system 10 provides a more efficient way to lay down the pavers P. Moreover, the spacers 40, 42, 44 eliminate time that may be used to measure and evenly space the pavers P. All the gaps or joints between each paver P are then filled with small stone chips, permeable sand or similar material.

Figure 6:
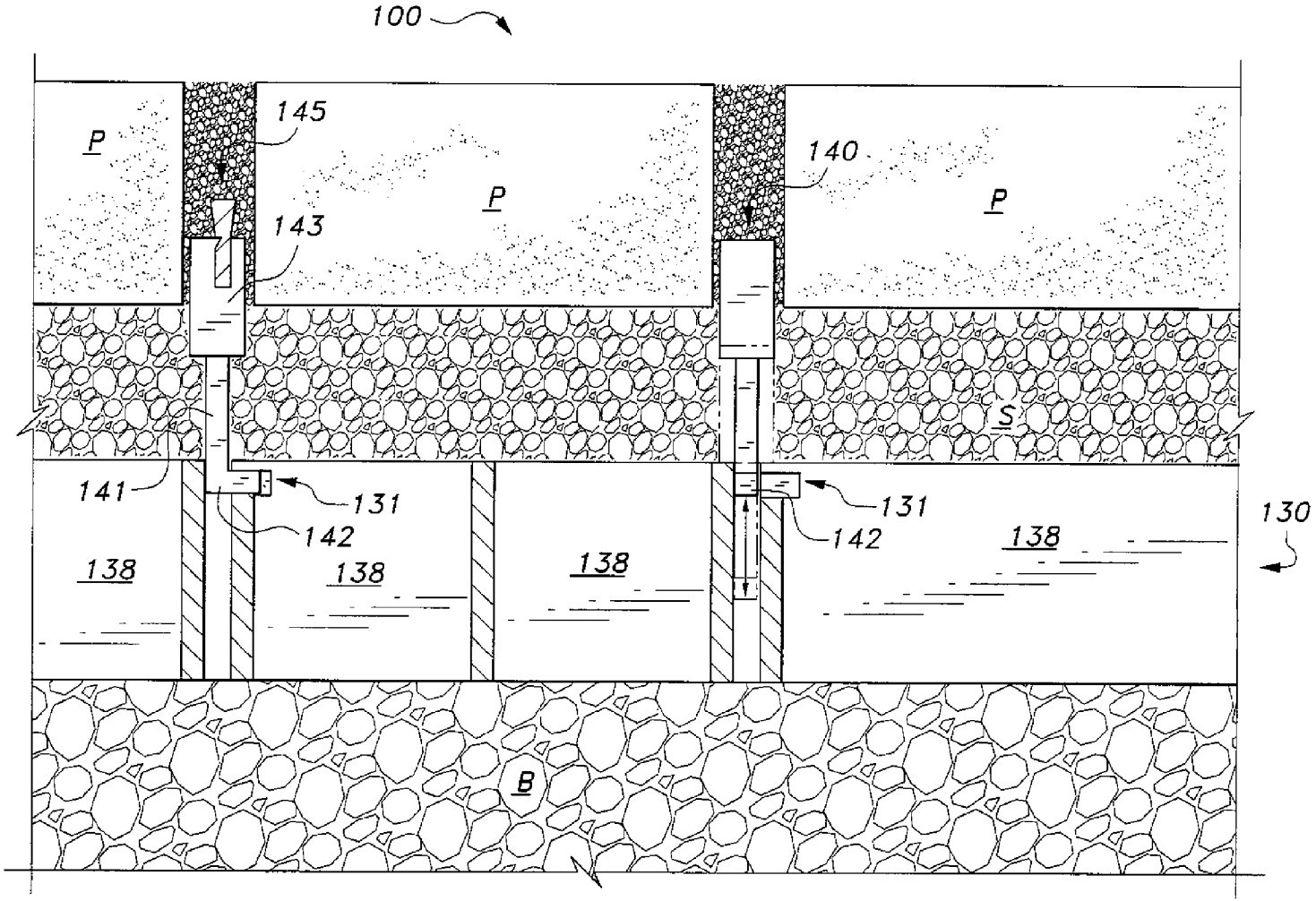
FIG. 6 is an environmental side view in section of an alternative embodiment of a paver installation system according to the present invention.
Figure 7:
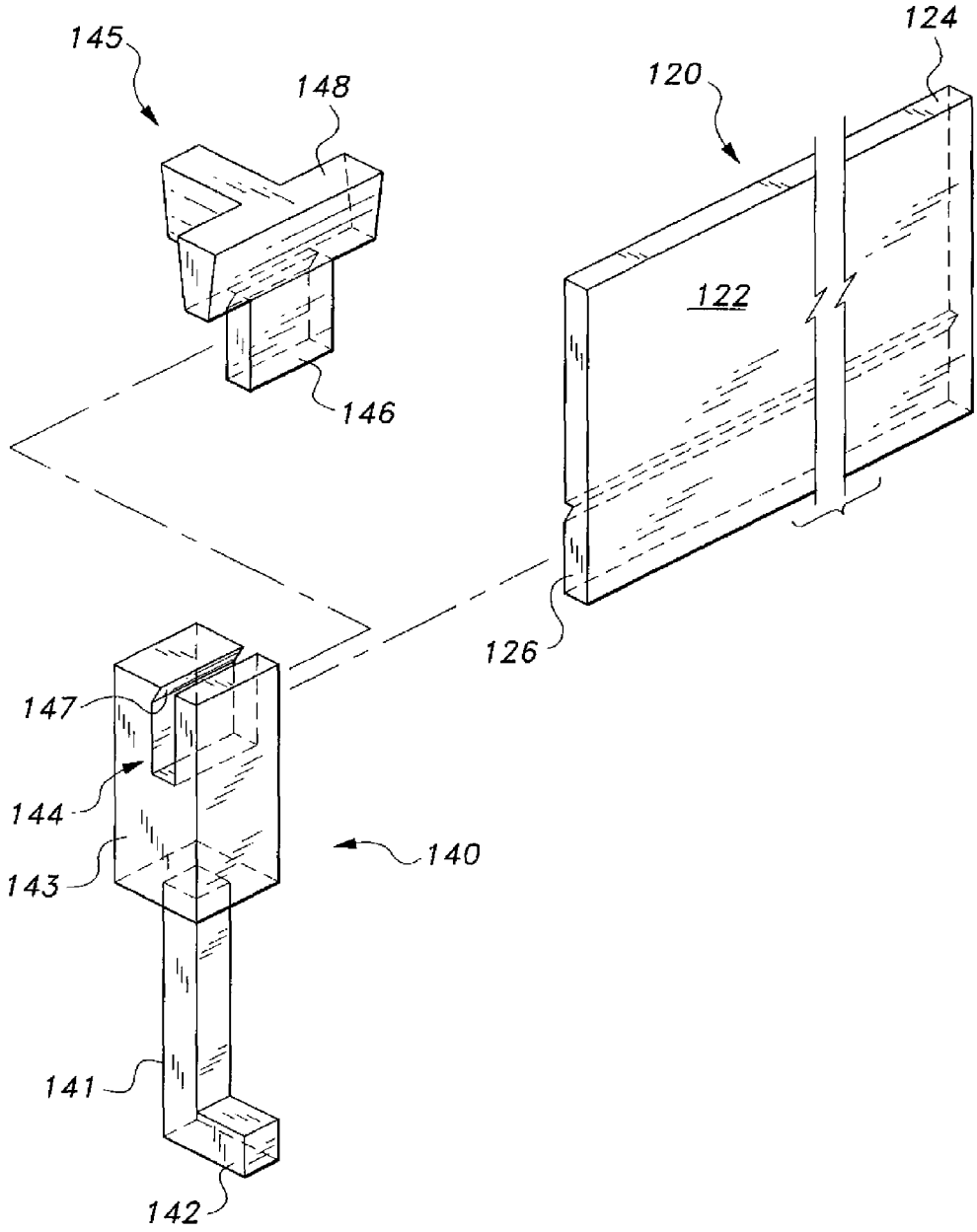
FIG. 7 is a perspective view of an alternative embodiment of a spacer for a paver installation system according to the present invention.

An alternative embodiment of the paver installation system, generally referred to be reference number 100 in the drawings, is shown in FIGS. 6 and 7. The alternative paver installation system 100 is similar in most respects to the paver installation system 10 except for the grid or mat 130 and the spacers 140. In this embodiment, the spacers 140 are pre-installed in the grid 130.

As shown in FIG. 6, the grid includes mounting columns or posts 136 having a mounting hole 137 through which a spacer 140 may be mounted to slide between a first or initial position (shown in broken lines) and a second position (shown in solid lines). In the first position, selected spacers 140 may be used to install a screed guide rail 120 thereon for screeding the intermediate layer S. As an alternative, the screed guide rail 120 may also be pre-installed in the grid 130. In the second position, selected spacer heads may be mounted on pegs 141 to set the desired paver layout pattern and the spacing between adjacent pavers. The user may also mount the screed guide rail 120 in the second position of the spacers 140, depending on the thickness of the intermediate layer S desired. In addition, the top of the chambers 138 may be partially covered to minimize accumulation of the intermediate layer S and thereby act as a drainage cell for storing water and the dispersion thereof.

To facilitate positioning of the spacers 140 and selective mounting of the screed guide rail 120 and the various different spacer head configurations, the spacer 140 includes a mounting post or peg 141 extending from the bottom of a mounting head 143. The distal end of the mounting peg 141 includes a locking extension or leg 142 extending orthogonal to the mounting peg 141. Unlike the grid 30, the interior of the mounting hole 137 is rectangular in shape to accommodate the vertical movement of the mounting peg 141 and the locking leg 142 thereon. Moreover, the grid 130 includes a locking pocket or recess 131 for the locking leg 142. When the spacer 140 is pulled upwardly into the second position, the user rotates the spacer 140 one-quarter or half turn to seat the locking leg 142 into the respective pocket 131 and thereby lock the spacer 140 into the second, raised position.

In this embodiment, the spacer 140 includes further features expanding the versatility thereof. In addition to functioning as a guide for pattern layout and uniform spacing, the spacer 140 may also be used to mount the screed guide rail 120. As shown in FIG. 7, the spacer 140 includes a mounting head 143 on which the user may selectively mount either the screed guide rail 120 or one of several spacer fin configurations. To facilitate this, the mounting head 143 includes an elongate, mounting groove, way, channel or slot 144. The mounting groove 144 may be a substantially rectangular groove having a beveled edge 147 at the top to constrict the top opening. This polyhedral shape of the mounting groove 144 in cross section locks the mounted element and prevents the element from being pulled out of the mounting groove 144, as will be further detailed below. Moreover, the lipped section formed thereby allows some flexing to ease mounting of the selected element.

To mount the screed guide rail 120, the screed guide rail 120 includes an elongate, rectangular beam or bar 122 with a top screed guide edge 124 and an integral mounting bar, beam or rail 126 in the lower portion of the screed guide rail 120. The mounting bar 126 has a cross-sectional shape corresponding to the shape of the mounting groove 144. Thus, the mounting bar 126 may be slid into the mounting groove 144 to mount the screed guide rail 120. This dovetail-like join between the mounting bar 126 and the mounting groove 144 permits lateral sliding movement for installation, while preventing any upward or dismounting movement of the screed guide rail 120. In the alternative where the screed guide rail 120 is pre-installed, the screed guide rail 120 may be pulled up to place the attached spacers 140 into the second position. The screed guide rail 120 may then be removed and select spacers 140 may be rotated to lock the select spacers 140 in the second position.

To mount the various spacer heads, reference is made to the exemplary embodiment of the T-shaped spacer head 145 in FIG. 7. It is noted that while FIG. 7 shows only one example of a spacer head, similarly shaped heads, such as the L-shaped head 43 and the cross-shaped head 47 shown in FIG. 4, may be used as a spacer head in accordance with the teachings of the spacer head 145. The T-shaped spacer head 145 includes a top portion 148 having wedge-shaped radiating fins or dividers forming the T-shape. The lower portion of the T-shaped spacer head 145 includes an integral mounting beam, bar or rail 146 with a cross-sectional shape corresponding to the shape of the mounting groove 144. Thus, the mounting bar 146 may be slid into the mounting groove 144 to mount the T-shaped spacer head 145. This dovetail-like joint between the mounting bar 146 and the mounting groove 144 permits lateral sliding movement for installation, while preventing any upward or dismounting movement of the T-shaped spacer head 145. As noted above, the L-shaped head 43 and the cross-shaped head 47 shown in FIG. 4 may be similarly configured to include a mounting bar 146 for selective installation thereof onto the mounting head 143. The mounting head 143 and/or the various spacer heads may be color-coded for faster and easier installation.

The steps for using the paver installation system 100 are substantially the same as the paver installation system 10, with the following modifications. When the screed guide rail 120 is to be used, the screed guide rail 120 may be installed or pre-installed in the corresponding spacers 140 when the corresponding spacers 140 are in the first position. After screeding, the screed guide rail 120 is pulled upwardly resulting in the spacers 140 being in the second position. The screed guide rail 120 may then be removed. Since the spacers 140 for the screed guide rail 120 as well as the rest of the spacers 140 are already mounted in the mounting holes 137, the user raises selected spacers 140 and locks them into the second position with a one-quarter or half turn in preparation for laying out the pavement pattern guides. Then the T-shaped spacer head 145 and others may be used for pattern layout.

Thus, it can be seen that the paver installation system 10, 100 facilitates faster and more efficient installation of pavers in the desired patterns. Moreover, the chambers 38, 138 help to store water and disperse the same back into the ground.

It is noted that the paver installation system 10, 100 encompasses a variety of alternatives. For example, the pattern on the grid 30, 130 can be any desired pattern as long as space is provided for storing water and/or aggregate material. Moreover, the spacer head configuration is not limited to those discussed above and may include a straight-line shape, curved shapes, or oblique shapes. Furthermore, the mounting groove 144, the mounting bar 146 and the mounting bar 126 may have different matching cross-sectional shapes for slidable mounting and retention of the spacer head 145 or the screed guide rail 120. Still further, the grids 30, 130 may be stackable.

It is to be understood that the present invention is not limited to the embodiments described above, but encompasses any and all embodiments within the scope of the following claims.

I claim:

1. A paver installation system, comprising:

a grid for laying pavers in a desired layout pattern to form a paved surface, the grid having a plurality of straight and curved walls forming a pattern thereon, the grid pattern having a plurality of chambers, the chambers being adapted to store water and disperse the same back into the ground;

a plurality of mounting posts integrally formed with and supported by the grid, the mounting posts defining mounting holes;

a screed guide rail detachably mounted to the grid, the screed guide rail having a guide edge disposed at a predetermined height with respect to the grid, the screed guide rail providing a guide for leveling an intermediate layer of aggregate material deposited on top of the grid;

flexible edging fixedly mounted to the grid to set edges of the paved surface; and a plurality of spacers removably mounted in select mounting holes on the grid, forming a guide for laying the pavers in any desired layout pattern and for uniformly spacing the pavers on the grid;

wherein the grid maintains uniform surface level of the pavers by preventing settling of individual pavers.

2. The paver installation system according to claim 1, wherein said mounting posts extend to a height less than said guide edge.

3. The paver installation system according to claim 2, wherein the height of the mounting posts is about 1/32 in. less than the height of said guide edge.

4. The paver installation system according to claim 1, wherein said screed guide rail comprises:

a elongate, flat rectangular beam having a top edge and a bottom, the top edge defining the guide edge; and a plurality of spaced mounting pegs disposed on the bottom of the rectangular beam for detachably mounting said screed guide rail to said grid.

5. The paver installation system according to claim 1, wherein said flexible edging comprises:

an elongate, flat rectangular strip made from flexible material in order to accommodate curves in the paved surface, the rectangular beam having a bottom edge; and a plurality of spaced mounting tabs extending orthogonal to the rectangular strip from the bottom edge, each of the mounting tabs having a mounting hole adapted for securing the flexible edging with fasteners.

6. The paver installation system according to claim 1, wherein each of said spacers comprises:

a mounting peg for mounting said spacer in one of the mounting holes on said grid; and a head disposed on the mounting post, the head having at least one radially extending fin forming a shape for the head.

7. The paver installation system according to claim 6, where each fin is wedge-shaped to help prevent movement of the pavers.

8. The paver installation system according to claim 7, wherein the shape for said spacer head is selected from the group consisting of L-shape, T-shape or cruciform.

9. The paver installation system according to claim 6, wherein the shape for said spacer head is selected from the group consisting of L-shape, T-shape or cruciform.

10. The paver installation system according to claim 1, wherein each said mounting post has a locking recess disposed adjacent the top of the mounting hole.

11. The paver installation system according to claim 10, wherein each of said plurality of spacers is movable between a first, rest position and a second, raised position with respect to a top surface of said mounting posts on said grid, each of the spacers comprising:

a mounting peg insertable into the mounting holes in said grid, the mounting peg having upper and lower ends;

a locking leg extending perpendicular to the mounting peg at a lower a end of the mounting peg, the locking leg being engageable with the locking recess to lock said spacer in the second position;

a spacer head having a top and bottom sections, the top section of the spacer head having at least one radially extending fin forming a shape for the spacer head; and a mounting head disposed on the upper end of the mounting peg, the mounting head having a mounting groove extending across the mounting head for selectively mounting the spacer head, the mounting groove having a cross-sectional shape permitting slidable mounting of the spacer head in one direction and preventing the spacer head from being pulled out of the mounting groove in an orthogonal direction;

wherein each of the spacers is selectively raised to and locked in the second position by rotating the locking leg into the locking recess to thereby set the desired layout pattern of the pavers.

12. The paver installation system according to claim 11, wherein the mounting groove comprises a substantially U-shaped channel having a beveled edge near a top portion of the U-shaped channel.

13. The paver installation system according to claim 11, further comprising a mounting bar formed on the bottom section of the spacer head, the mounting bar having a cross-sectional shape matching the cross-sectional shape of the mounting groove.

14. The paver installation system according to claim 13, where each fin is wedge-shaped to help prevent filling material between pavers from escaping.

15. The paver installation system according to claim 14, wherein the shape of said spacer head is selected from the group consisting of L-shaped, T-shaped, or cruciform.

16. The paver installation system according to claim 11, wherein the shape of said spacer head is selected from the group consisting of L-shaped, T-shaped, or cruciform.

17. The paver installation system according to claim 11, wherein said screed guide rail comprises:

a elongate, flat rectangular beam having a top edge and a bottom section, the top edge defining the guide edge; and a mounting bar formed on the bottom section of the rectangular beam, the mounting bar having a cross-sectional shape corresponding to the cross-sectional shape of the mounting groove.

18. A method for installing pavers to form a patterned pavement, comprising the steps of:

excavating ground to a predetermined depth in preparation for laying down pavers in a desired pattern;

laying down a layer of base material;

compacting and leveling the layer of base material;

placing a grid on top of the layer of base material, the grid having a plurality of straight and curved walls forming a pattern thereon, the grid pattern having a plurality of chambers and mounting posts supported by the grid, each of the mounting posts defining a mounting hole, the chambers being adapted to store water and disperse the water back into the ground;

mounting flexible edging to the grid with fasteners;

installing a screed guide rail having a guide edge to the grid at a predetermined height;

laying down an intermediate layer of material on top of the grid;

screeding the intermediate layer of material by running a bar along the guide edge;

insertably mounting a plurality of spacers in user-selected mounting holes on the grid to form a guide for laying the pavers in any desired layout pattern and for uniformly spacing the pavers on the grid;

placing pavers on the intermediate layer following the desired layout pattern formed by the spacers; and filling joints between pavers with aggregate material;

wherein the grid maintains uniform surface level of the pavers by preventing settling of individual pavers.

19. The method for installing pavers according to claim 18, further comprising the steps of:

providing a plurality of spacers movable between a first, rest position and a second, raised position with respect to a top surface of said mounting posts on said grid; and locking select spacers in the second position by rotating the select spacers within respective mounting posts to set the desired layout pattern.

20. The method for installing pavers according to claim 19, wherein the step of installing said screed guide rail comprises:

mounting said screed guide rail on select movable spacers in said first position;

raising said screed guide rail and the corresponding attached movable spacers into said second position after screeding; and removing said screed guide rail after screeding;

wherein the corresponding movable spacers are selectively locked in said second position by rotating these spacers within respective mounting posts to set the desired layout pattern.

* * * * *